US009966683B2

(12) United States Patent
Sasaki et al.

(10) Patent No.: US 9,966,683 B2
(45) Date of Patent: May 8, 2018

(54) CONNECTOR TERMINAL

(71) Applicant: Japan Aviation Electronics Industry, Limited, Tokyo (JP)

(72) Inventors: Takuo Sasaki, Tokyo (JP); Tomoki Kataoka, Tokyo (JP); Osamu Hashiguchi, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days. days.

(21) Appl. No.: 15/425,569

(22) Filed: Feb. 6, 2017

(65) Prior Publication Data

US 2017/0302018 A1 Oct. 19, 2017

(30) Foreign Application Priority Data

Apr. 14, 2016 (JP) ..... 2016-081134

(51) Int. Cl.
*H01R 13/11* (2006.01)

(52) U.S. Cl.
CPC ..... *H01R 13/113* (2013.01)

(58) Field of Classification Search
CPC .... H01R 13/113; H01R 13/114; H01R 13/115
See application file for complete search history.

(56) References Cited

U.S. PATENT DOCUMENTS 5,624,289 A * 4/1997 Kourimsky ..... H01R 13/11 439/852
7,845,993 B2 * 12/2010 Falchetti ..... H01R 13/113 439/843
2010/0197177 A1 8/2010 Myer et al.
2013/0109250 A1 5/2013 Haga

FOREIGN PATENT DOCUMENTS

JP 2013-098088 A 5/2013
WO WO-2011/125727 A1 10/2011

OTHER PUBLICATIONS

Extended European Search Report dated Mar. 30, 2017 is corresponding European patent application No. 17157054 (8 pages).

* cited by examiner

*Primary Examiner* — Ross Gushi
(74) *Attorney, Agent, or Firm* — Muncy, Geissler, Olds & Lowe, P.C.

(57) ABSTRACT

A connector terminal includes two top side contact points each of which makes point contact with a top surface of a counter connector terminal and three bottom side contact points each of which makes point contact with a bottom surface of the counter connector terminal and which are not aligned in a straight line, the two top side contact points doing not overlap the three bottom side contact points when viewed in a direction perpendicular to the top surface of the counter connector terminal in a fitted state, a position of a center of gravity as determined by arrangement positions of the two top side contact points coincides with a position of a center of gravity as determined by arrangement positions of the three bottom side contact points when viewed in the direction perpendicular to the top surface of the counter connector terminal in the fitted state.

7 Claims, 4 Drawing Sheets

CONNECTOR TERMINAL

BACKGROUND OF THE INVENTION

The present invention relates to a connector terminal, particularly to a connector terminal that, when being fitted with a counter connector terminal, which has a flat plate shape and has top and bottom surfaces, along a fitting axis so that its contact points corresponding to the top and bottom surfaces of the counter connector terminal come into contact with the top and bottom surfaces, enables the electric connection with the counter connector terminal to be established.

In electric wiring using, for instance, a wire harness for vehicles, a connector has heretofore widely been used which establishes the electric connection when a plug terminal in a flat plate shape is inserted into a socket terminal in a box shape so that the plug terminal is sandwiched from top and bottom between a plurality of contact points of the socket terminal.

For instance, JP 2013-98088 A discloses a connector terminal in which a socket terminal 1 has three elongate convex contact portions 2A to 2C formed on an inner facing contact surface 2 and one dome-shaped embossed contact 3A formed on a resilient contact piece 3 and a flat plug terminal 4 is sandwiched between the elongate convex contact portions 2A to 2C and the dome-shaped embossed contact 3A, as shown in FIG. 10.

As shown in FIG. 11, the three elongate convex contact portions 2A to 2C of the socket terminal 1 are disposed on the inner facing contact surface 2 so as to be positioned at three vertices of a triangle, and the dome-shaped embossed contact 3A is positioned in a central portion of the triangle formed by the three elongate convex contact portions 2A to 2C and at a substantially equal distance from any of the three elongate convex contact portions 2A to 2C.

When the plug terminal 4 is fitted with the socket terminal 1, the elongate convex contact portions 2A to 2C of the socket terminal 1 come into contact with a top surface 4A of the plug terminal 4, while the dome-shaped embossed contact 3A of the socket terminal 1 comes into contact with a bottom surface 4B of the plug terminal 4, whereby the electric connection is established between the socket terminal 1 and the plug terminal 4.

In the connector terminal described in JP 2013-98088 A and shown in FIGS. 10 and 11, when the socket terminal 1 and the plug terminal 4 are fitted with each other, the dome-shaped embossed contact 3A formed on the resilient contact piece 3 of the socket terminal 1 comes into contact with the bottom surface 4B of the plug terminal 4, so that the plug terminal 4 is elastically pressed against the inner facing contact surface 2 of the socket terminal 1, and accordingly, a load is exerted from the top surface 4A of the plug terminal 4 to each of the three elongate convex contact portions 2A to 2C formed on the inner facing contact surface 2 of the socket terminal 1.

When loads acting on the three elongate convex contact portions 2A to 2C are unequal, the contact resistance between each of the elongate convex contact portions 2A to 2C and the top surface 4A of the plug terminal 4 varies, which may cause heat to be locally generated.

SUMMARY OF THE INVENTIION

The present invention aims at removing the drawback described above and providing a connector terminal that can reduce the variance in contact resistance among a plurality of contact points that make contact with a counter connector terminal in a flat plate shape, thereby preventing heat from being locally generated.

A connector terminal according to the present invention is one that, when being fitted along a fitting axis with a counter connector terminal in a flat plate shape having a top surface and a bottom surface such that its contact points separately corresponding to the top surface and the bottom surface of the counter connector terminal come into contact with the top surface and the bottom surface, establishes an electric connection with the counter connector terminal, the connector terminal comprising:

one or more top side contact points each of which makes point contact with the top surface of the counter connector terminal; and three or more bottom side contact points each of which makes point contact with the bottom surface of the counter connector terminal and which are not aligned in a straight line, wherein the one or more top side contact points do not overlap the three or more bottom side contact points when viewed in a direction perpendicular to the top surface of the counter connector terminal in a fitted state, and wherein a position of a center of gravity as determined by arrangement positions of the one or more top side contact points coincides with a position of a center of gravity as determined by arrangement positions of the three or more bottom side contact points when viewed in the direction perpendicular to the top surface of the counter connector terminal in the fitted state.

DETAILED DESCRIPTION OF THE INVENTION

An embodiment of the present invention is described below based on the appended drawings.

Figure 1:
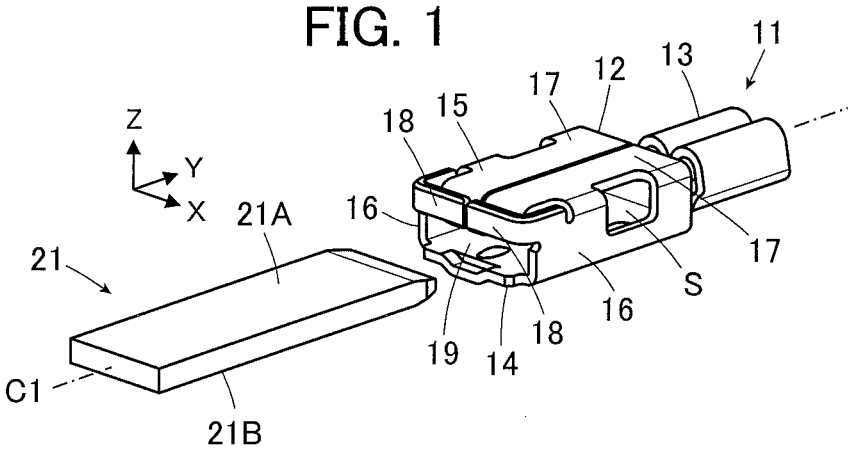
FIG. 1 is a perspective view showing a connector terminal according to an embodiment and a counter connector terminal in the non-fitted state.

As shown in FIG. 1, a connector terminal 11 according to the embodiment of the invention is a socket terminal including a socket portion 12 in a box shape having formed therein a counter connector terminal accommodating portion S, and a counter connector terminal 21 is a plug terminal in a flat plate shape. When the counter connector terminal 21 is inserted into the counter connector terminal accommodating portion S of the socket portion 12 of the connector terminal 11 along a fitting axis C1, the connector terminal 11 and the counter connector terminal 21 are fitted with each other, thus establishing the electric connection.

The connector terminal 11 includes an electric wire holding portion 13 that is formed at the back end of the socket portion 12 along the fitting axis C1 to be integral with the socket portion 12.

The socket portion 12 includes a bottom plate portion 14, a ceiling portion 15 facing the bottom plate portion 14 in parallel therewith, and a pair of lateral wall portions 16 each of which connects either lateral end of the bottom plate portion 14 to the corresponding lateral end of the ceiling portion 15. The ceiling portion 15 is divided at its center portion along the fitting axis C1 into two upper plate portions 17 that are connected to the corresponding lateral wall portions 16.

A pair of fence portions 18 are formed at the front end of the socket portion 12 opposite from the end at which the electric wire holding portion 13 is located. The fence portions 18 each extend from the front end of the corresponding lateral wall portion 16 to the vicinity of the fitting axis C1 in a direction perpendicular to the lateral wall portion 16, so as to cover the front end of the socket portion 12. The fence portions 18 are smaller in thickness than the lateral wall portions 16. While having the upper edge positioned at a height substantially the same as the ceiling portion 15, each of the fence portions 18 has the lower edge that does not reach the bottom plate portion 14. With this configuration, an insertion port 19 for receiving the counter connector terminal 21 is formed between the pair of fence portions 18 and the front end of the bottom plate portion 14. The pair of fence portions 18 serve as a guide for insertion of the counter connector terminal 21.

For ease of understanding, a plane along which the bottom plate portion 14 and ceiling portion 15 of the socket portion 12 extend is called "XY plane," a plane along which the lateral wall portions 16 extend "YZ plane," a direction in which the fitting axis C1 extends from the socket portion 12 toward the electric wire holding portion 13 "+Y direction," and a direction from the bottom plate portion 14 of the socket portion 12 toward the ceiling portion 15 thereof "+Z direction."

The counter connector terminal 21 is of a flat plate shape having a uniform thickness and extending along an XY plane. The counter connector terminal 21 includes a top surface 21A extending along the XY plane and facing in the +Z direction and a bottom surface 21B extending along the XY plane in parallel with the top surface 21A and facing in the −Z direction.

Figure 2:
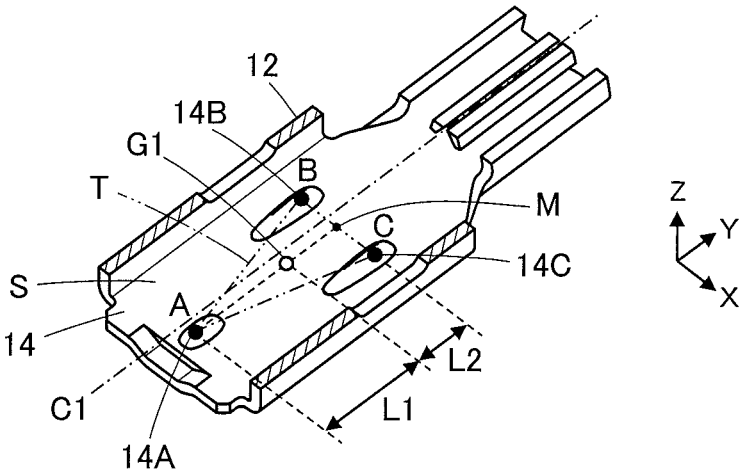
FIG. 2 is a cutaway perspective view showing a lower portion of the connector terminal according to the embodiment.

FIG. 2 is a drawing showing only a −Z direction-side portion of the socket portion 12 with a +Z direction-side half of the connector terminal 11 being removed. As shown in FIG. 2, three bottom side contact points 14A to 14C are formed on the bottom plate portion 14 of the socket portion 12. Each of the three bottom side contact points 14A to 14C has a dome shape, projects in the +Z direction inside the counter connector terminal accommodating portion S, and is a non-spring contact point that makes point contact with the bottom surface 21B of the counter connector terminal 21 in the fitted state. The three bottom side contact points 14A to 14C are arranged to form an isosceles triangle T in an XY plane with the bottom side contact point 14A being set as a vertex A and a line segment connecting the remaining bottom side contact points 14B and 14C being set as a base BC.

The base BC of the isosceles triangle T extends in the X direction, and a median AM connecting a midpoint M of the base BC to the vertex A of the isosceles triangle T extends in the Y direction. The isosceles triangle T is symmetrical with respect to a YZ plane passing through the median AM. The median AM of the isosceles triangle T is positioned in the same YZ plane as the YZ plane passing through the fitting axis C1, and the three bottom side contact points 14A to 14C are arranged symmetrically with respect to the YZ plane passing through the fitting axis C1, i.e., with respect to a perpendicular that is a plane perpendicular to the top surface 21A of the counter connector terminal 21 in the fitted state and passes through the fitting axis C1.

Now, the center of gravity of the three bottom side contact points 14A to 14C is considered. In general, when a uniform load is applied to each of plural points, the center of gravity of the plural points is to be a point that allows forces and moments caused by the applied loads to be balanced, and can be defined as a point of action on which a resultant force of the loads applied to the plural points act. For instance, when a load W1 acting in the −Z direction is applied to each of the three bottom side contact points 14A to 14C, it is assumed that moments associated with the loads W1 balance out at a geometrical center of gravity of the isosceles triangle T formed with the three bottom side contact points 14A to 14C, i.e., a point G1 that internally divides the median AM in such a manner that a distance L1 from the vertex A is twice as long as a distance L2 from the midpoint M, and a resultant force F1=3×W1 acting in the −Z direction is exerted on the point G1. Therefore, the point G1 is referred to as a center of gravity determined by arrangement positions of the three bottom side contact points 14A to 14C.

Figure 3:
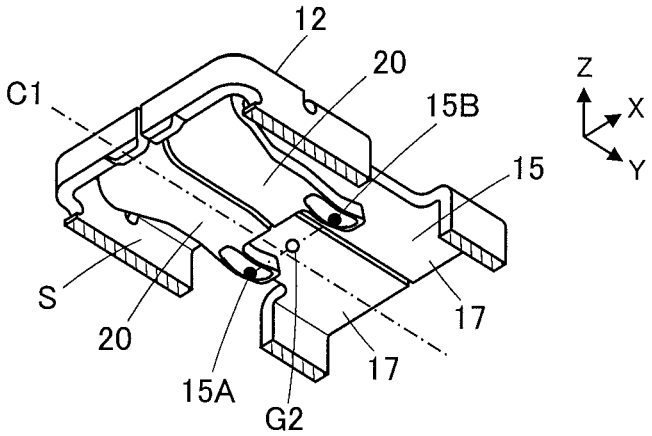
FIG. 3 is a cutaway perspective view showing an upper portion of the connector terminal according to the embodiment.

FIG. 3 is a drawing showing only a +Z direction-side portion of the socket portion 12 with a −Z direction-side half of the connector terminal 11 being removed. As shown in FIG. 3, two top side contact points 15A and 15B are formed at the ceiling portion 15 of the socket portion 12. At the ceiling portion 15, −Y direction-side ends of the two upper plate portions 17 are so bent back toward the inside of the socket portion 12 as to extend in the +Y direction, thus forming a pair of spring portions 20 having a cantilever shape in the counter connector terminal accommodating portion S. The top side contact points 15A and 15B are separately disposed at the tip ends of the spring portions 20. The pair of spring portions 20 are the same in size and spring constant.

The top side contact points 15A and 15B are formed by working the tip ends of the spring portions 20. Each of the top side contact points 15A and 15B has a dome shape symmetrical with respect to a YZ plane passing through the top side contact point 15A or 15B, projects in the −Z direction inside the counter connector terminal accommodating portion S, and constitutes a spring contact point that makes point contact with the top surface 21A of the counter connector terminal 21 in the fitted state.

The top side contact points 15A and 15B are positioned on a straight line extending in the X direction, and a midpoint of a line segment connecting the top side contact points 15A and 15B is positioned on the same YZ plane as the YZ plane passing through the fitting axis C1. Thus, the two top side contact points 15A and 15B are arranged symmetrically with respect to the YZ plane passing through the fitting axis C1, i.e., a perpendicular that is a plane perpendicular to the top surface 21A of the counter connector terminal 21 in the fitted state and passes through the fitting axis C1.

When a load W2 acting in the +Z direction is applied to each of the two top side contact points 15A and 15B, it is assumed that moments associated with the loads W2 balance out at a midpoint G2 of the line segment connecting the top side contact points 15A and 15B, and a resultant force F2=2×W2 acting in the +z direction is exerted on the point G2. Therefore, the point G2 is referred to as a center of gravity determined by arrangement positions of the two top side contact points 15A and 15B.

Figure 4:
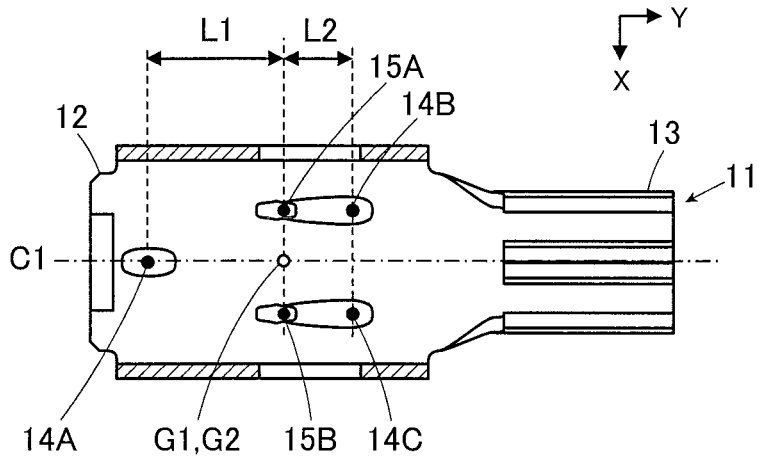
FIG. 4 is a cutaway plan view showing the arrangement of top side contact points and bottom side contact points of the connector terminal according to the embodiment.
Figure 5:
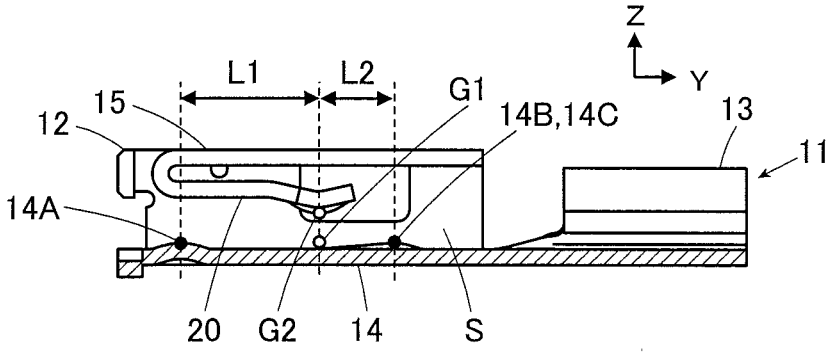
FIG. 5 is a cutaway side view showing the internal structure of the connector terminal according to the embodiment.

As shown in FIGS. 4 and 5, when viewed in the Z direction, that is, a direction perpendicular to the top surface 21A of the counter connector terminal 21 in the fitted state, the top side contact points 15A and 15B are arranged so as not to overlap the three bottom side contact points 14A to 14C. In addition, the three bottom side contact points 14A to 14C and the top side contact points 15A and 15B are arranged so that, as viewed in the Z direction, the position of the center of gravity G1 as determined by the arrangement positions of the three bottom side contact points 14A to 14C coincides with the position of the center of gravity G2 as determined by the arrangement positions of the two top side contact points 15A and 15B.

Figure 6:
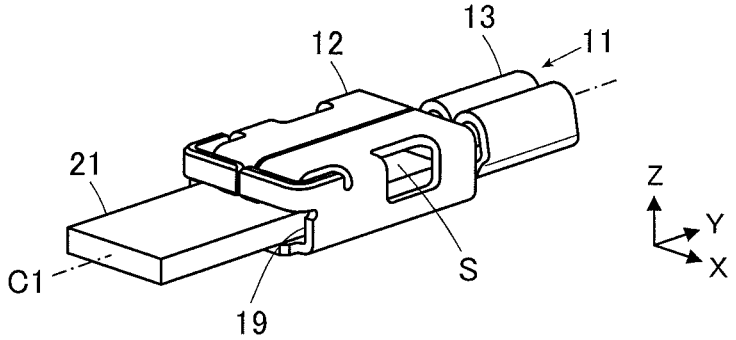
FIG. 6 is a perspective view showing the connector terminal according to the embodiment and the counter connector terminal in the fitted state.

Next, the function of the connector terminal 11 in a fitting process is described. As shown in FIG. 6, when the counter connector terminal 21 is inserted into the counter connector terminal accommodating portion S through the insertion port 19 of the socket portion 12 of the connector terminal 11, the two spring portions 20 shown in FIG. 3 elastically deform, whereby the two top side contact points 15A and 15B disposed at the ceiling portion 15 of the socket portion 12 come into point contact with the top surface 21A of the counter connector terminal 21, while the three bottom side contact points 14A to 14C arranged on the bottom plate portion 14 of the socket portion 12 as shown in FIG. 2 come into point contact with the bottom surface 21B of the counter connector terminal 21.

The counter connector terminal 21 is of a flat plate shape having a uniform thickness and extending along an XY plane. Since the two spring portions 20 on which the top side contact points 15A and 15B are disposed are the same in size and spring constant, when the two spring portions 20 elastically deform upon insertion of the counter connector terminal 21, contact forces N1 having the same magnitude and acting in the −Z direction are separately exerted from the two top side contact points 15A and 15B of the socket portion 12 to the top surface 21A of the counter connector terminal 21. Therefore, the point of action of a resultant force 2×N1 of the two contact forces N1 is to be positioned at the center of gravity G2 determined by the arrangement positions of the two top side contact points 15A and 15B. Because of the law of action-reaction, loads N1 having the same magnitude and acting in the +Z direction are separately exerted from the top surface 21A of the counter connector terminal 21 to the two top side contact points 15A and 15B.

Since the counter connector terminal 21 receives the resultant force 2×N1 of the contact forces N1 from the top side contact points 15A and 15B, loads acting in the -Z direction are separately exerted on the three bottom side contact points 14A to 14C of the socket portion 12 through the bottom surface 21B of the counter connector terminal 21. At this time, as described above, the position of the center of gravity G1 as determined by the arrangement positions of the three bottom side contact points 14A to 14C coincides with the position of the center of gravity G2 as determined by the arrangement positions of the two top side contact points 15A and 15B as viewed in the Z direction, and accordingly, the resultant force 2×N1 acting on the center of gravity G2 directly acts on the center of gravity G1. As a result, components of force having the same magnitude and acting in the −Z direction are separately exerted as loads on the three bottom side contact points 14A to 14C, thereby achieving the balance of forces and the balance of moments. More specifically, a load N2 with a magnitude of (2×N1)/3 acts on each of the bottom side contact points 14A to 14C.

Thus, the loads N2 equally act on the three bottom side contact points 14A to 14C, which leads to decreased variance in contact resistance among the bottom side contact points 14A to 14C that make contact with the bottom surface 21B of the counter connector terminal 21 in a flat plate shape, thereby preventing heat from being locally generated. Likewise, the loads N1 equally act on the two top side contact points 15A and 15B, which leads to decreased variance in contact resistance among the top side contact points 15A and 15B that make contact with the top surface 21A of the counter connector terminal 21 in a flat plate shape, thereby preventing heat from being locally generated.

Figure 11:
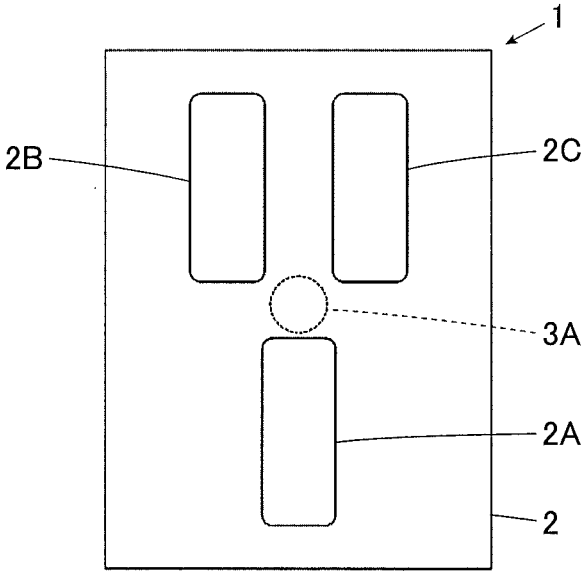
FIG. 11 PRIOR ART
FIG. 11 is a plan view schematically showing the conventional connector terminal.

Since the bottom side contact points 14A to 14C and the top side contact points 15A and 15B are contact points each making point contact, it is possible to determine the center of gravity G1 associated with the arrangement positions of the three bottom side contact points 14A to 14C as well as the center of gravity G2 associated with the arrangement positions of the two top side contact points 15A and 15B so that the center of gravities G1 and G2 coincide with each other as viewed in the Z direction. In contrast, when a plurality of contact portions that each make not point contact but line or surface contact are provided as in the case of employing the elongate convex contact portions 2A to 2C of the conventional connector terminal shown in FIG. 11, it is difficult to specify, within such a contact portion, a point where contact is actually made, and therefore, a center of gravity cannot be determined by arrangement positions of the plurality of contact portions. Thus, the present invention is not applicable to this case.

In the above embodiment, as shown in FIG. 4 for example, the top side contact point 15A and the bottom side contact point 14B are positioned in a single YZ plane, and the top side contact point 15B and the bottom side contact point 14C are positioned in another single YZ plane; however, the present invention is not limited to this configuration, and a distance between the two top side contact points 15A and 15B may differ from a distance between the two bottom side contact points 14B and 14C out of the three bottom side contact points 14A to 14C.

In addition, while in the above embodiment, the two top side contact points 15A and 15B are provided, the number of top side contact points may be one. In this case, since only one top side contact point is provided, the position of the top side contact point is to be a center of gravity determined by an arrangement position of the top side contact point. In other words, the single top side contact point is disposed at the center of gravity G2 shown in FIG. 3.

Figure 7:
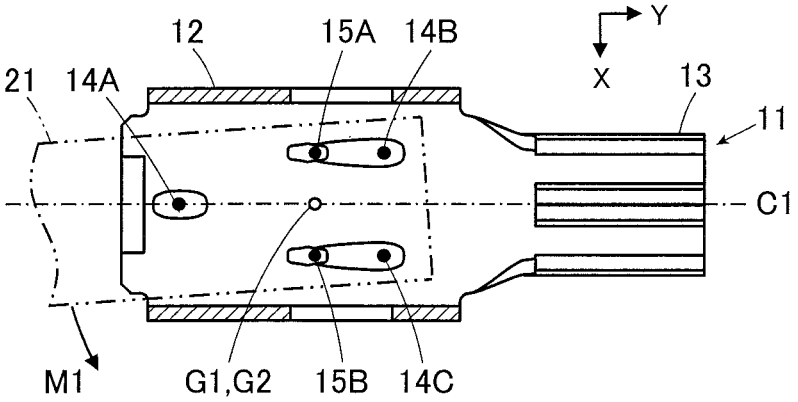
FIG. 7 is a cutaway plan view showing the state where a moment in an XY plane acts on the counter connector terminal fitted with the connector terminal according to the embodiment.

In the case of having the two top side contact points 15A and 15B as in the above embodiment, however, when a moment M1 in the XY plane acts on the counter connector terminal 21 fitted with the connector terminal 11 as shown in FIG. 7, a frictional force is exerted from each of the two top side contact points 15A and 15B, which is effective in minimizing displacement of the counter connector terminal 21 in a rotational direction in the XY plane.

Figure 8:
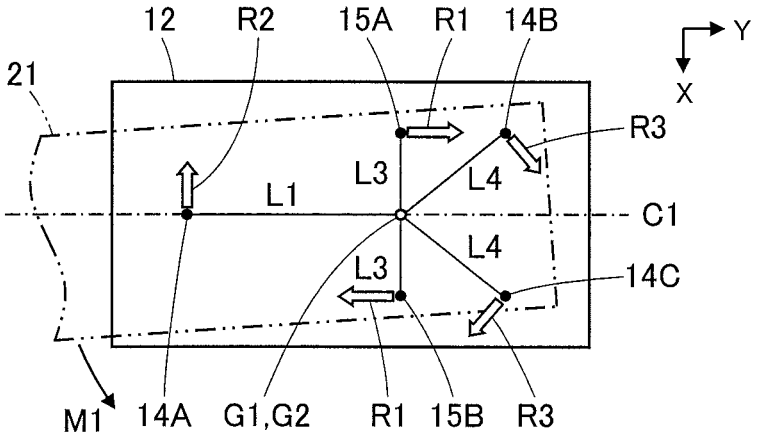
FIG. 8 is a plan view schematically showing frictional forces generated at the top and bottom side contact points when a moment in an XY plane acts on the counter connector terminal fitted with the connector terminal according to the embodiment.

Such a frictional force is exerted also from each of the bottom side contact points 14A to 14C in contact with the bottom surface 21B of the counter connector terminal 21. Assuming that the counter connector terminal 21 is rotated about the center of gravities G1 and G2 when viewed in the Z direction, as shown in FIG. 8, frictional forces R1 are separately exerted from the top side contact points 15A and 15B, a frictional force R2 is exerted from the bottom side contact point 14A, and frictional forces R3 are separately exerted from the bottom side contact points 14B and 14C. Thus, those frictional forces serve to suppress the rotation of the counter connector terminal 21.

When the moment M1 acting on the counter connector terminal 21 is balanced with the frictional forces R1 to R3, the following equation holds:

$$M1=(R1\times L3)\times 2+R2\times L1+(R3\times L4)\times 2$$

where a distance from the center of gravity G2 to the top side contact point 15A or 15B is denoted by L3, a distance from the center of gravity G1 to the bottom side contact point 14A by L1, and a distance from the center of gravity G1 to the bottom side contact point 14B or 14C by L4. Therefore, with the longer distance L3 between the center of gravity G2 and each of the top side contact points 15A and 15B, the configuration more effectively works against the moment M1, thereby minimizing displacement of the counter connector terminal 21 in a rotational direction.

Figure 9:
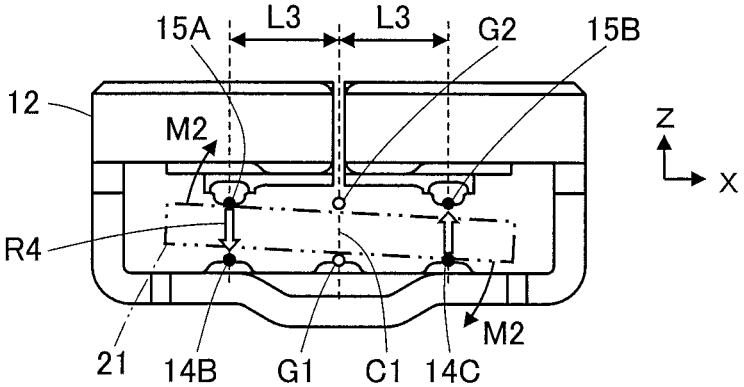
FIG. 9 is a front view showing the state where a moment in an XZ plane acts on the counter connector terminal fitted with the connector terminal according to the embodiment.
Figure 10:
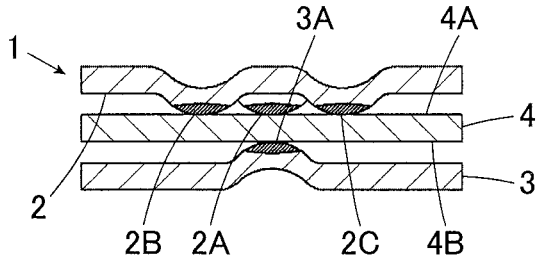
FIG. 10 PRIOR ART
FIG. 10 is a cross-sectional view schematically showing a conventional connector terminal in the fitted state.

In addition, as shown in FIG. 9, as long as the top side contact points 15A and 15B are positioned at the distance L3 from the center of gravity G2 in the −X and +X directions, respectively, even if a moment M2 about the fitting axis C1 acts on the counter connector terminal 21 fitted with the connector terminal 11, in addition to the contact forces N1 exerted from the top side contact points 15A and 15B to the counter connector terminal 21 upon fitting of the counter connector terminal 21, a normal force R4 having a magnitude corresponding to the moment M2 is exerted from one of the top side contact points 15A and 15B to the counter connector terminal 21, so that the displacement of the counter connector terminal 21 in a rotational direction in the XZ plane can be minimized.

The frictional forces R1 shown in FIG. 8 and the normal force R4 shown in FIG. 9 are generated because the top side contact points 15A and 15B are positioned at a distance from the center of gravity G2 in the −X and +X directions, respectively. If, for example, the configuration is employed in which a sole top side contact point is disposed at the position of the center of gravity G2, this top side contact point would not serve to minimize the rotation of the counter connector terminal 21 in the XY plane caused by the moment M1 or the rotation of the same in the XZ plane caused by the moment M2.

When three or more top side contact points are provided, it is still possible to cause the frictional forces R1 shown in FIG. 8 and the normal force R4 shown in FIG. 9 to act, thereby minimizing displacement of the counter connector terminal 21 in a rotational direction. Thus, even when, for instance, an external force acts due to vibration or other factors, the provision of two or more top side contact points enables displacement of the counter connector terminal 21 relative to the connector terminal 11 to be minimized, whereby the top and bottom side contact points are prevented from being worn away.

While having the three bottom side contact points 14A to 14C in the above embodiment, the socket portion 12 may be configured differently as long as it has three or more bottom side contact points each making point contact. Such three or more bottom side contact points, however, need to be arranged so as not to be aligned in a straight line. This is because, when three or more bottom side contact points align in a straight line, those bottom side contact points cannot stably retain the counter connector terminal 21 in an XY plane.

While in the above embodiment, the top side contact points 15A and 15B are formed by working the tip ends of the spring portions 20 integral to the ceiling portion 15 of the socket portion 12, a socket portion and spring portions having top side contact portions may be formed as separate components.

Aside from that, while being constituted of non-spring contact points, the three bottom side contact points 14A to 14C may be spring contact points as with the top side contact points 15A and 15B.

What is claimed is:

1. A connector terminal that, when being fitted along a fitting axis with a counter connector terminal in a flat plate shape having a top surface and a bottom surface such that its contact points separately corresponding to the top surface and the bottom surface of the counter connector terminal come into contact with the top surface and the bottom surface, establishes an electric connection with the counter connector terminal, the connector terminal comprising:

one or more top side contact points each of which makes point contact with the top surface of the counter connector terminal; and only three bottom side contact points each of which makes point contact with the bottom surface of the counter connector teiminal and which are not aligned in a straight line, wherein the one or more top side contact points do not overlap the only three bottom side contact points when viewed in a direction perpendicular to the top surface of the counter connector terminal in a fitted state, and wherein a position of a center of gravity as determined by arrangement positions of the one or more top side contact points coincides with a position of a center of gravity as determined by arrangement positions of the only three bottom side contact points when viewed in the direction perpendicular to the top surface of the counter connector terminal in the fitted state.

2. The connector terminal according to claim 1, wherein the one or more top side contact points are arranged symmetrically with respect to a perpendicular plane which is perpendicular to the top surface of the counter connector terminal in the fitted state and passes through the fitting axis, and wherein the only three bottom side contact points are arranged symmetrically with respect to the perpendicular plane.

3. The connector terminal according to claim 2, wherein the one or more top side contact points are each constituted of a spring contact point, and wherein the only three bottom side contact points are each constituted of a non-spring contact point.

4. The connector terminal according to claim 3, wherein the spring contact point has a symmetrical shape with respect to a plane being parallel to the perpendicular plane and passing through this spring contact point.

5. The connector terminal according to claim 1, wherein the one or more top side contact points comprise two contact points.

6. The connector terminal according to claim 1, wherein the one or more top side contact points and the only three bottom side contact points are each constituted of a dome-shaped contact point.

7. A connector terminal that, when being fitted along a fitting axis with a counter connector terminal in a flat plate shape having a top surface and a bottom surface such that its contact points separately corresponding to the top surface and the bottom surface of the counter connector terminal come into contact with the top surface and the bottom surface, establishes an electric connection with the counter connector terminal, the connector terminal comprising:

one or more top side contact points each of which makes point contact with the top surface of the counter connector terminal; and three or more bottom side contact points each of which makes point contact with the bottom surface of the counter connector terminal and which are not aligned in a straight line, wherein the one or more top side contact points do not overlap the three or more bottom side contact points when viewed in a direction perpendicular to the top surface of the counter connector terminal in a fitted state;

wherein a position of a center of gravity as determined by arrangement positions of the one or more top side contact points coincides with a position of a center of gravity as determined by arrangement positions of the three or more bottom side contact points when viewed in the direction perpendicular to the top surface of the counter connector terminal in the fitted state;

wherein the one or more top side contact points are arranged symmetrically with respect to a perpendicular plane which is perpendicular to the top surface of the counter connector terminal in the fitted state and passes through the fitting axis;

wherein the three or more bottom side contact points are arranged symmetrically with respect to the perpendicular plane;

wherein the one or more top side contact points are each constituted of a spring contact point;

wherein the three or more bottom side contact points are each constituted of a non-spring contact point;

wherein the one or more top side contact points comprise two contact points; and wherein the three or more bottom side contact points comprise three contact points.

* * * * *